United States Patent [19]

Goldbeck et al.

[11] Patent Number: 4,658,740

[45] Date of Patent: Apr. 21, 1987

[54] SEWN PART TRANSFER DEVICE FOR A SEWING MACHINE

[75] Inventors: Heinz Goldbeck; Klaus Möller, both of Bielefeld, Fed. Rep. of Germany

[73] Assignee: Durkoppwerke GmbH, Fed. Rep. of Germany

[21] Appl. No.: 738,047

[22] Filed: May 24, 1985

[30] Foreign Application Priority Data

May 26, 1984 [DE] Fed. Rep. of Germany ... 8416290[U]

[51] Int. Cl.[4] ..... D05B 3/18; D05B 31/00

[52] U.S. Cl. ..... 112/114; 112/121.15

[58] Field of Search ..... 112/113, 114, 121.12, 112/265.2, 121.15, 121.29, 105–107

[56] References Cited

U.S. PATENT DOCUMENTS

| | | | |
|---|---|---|---|
| 3,762,347 | 10/1973 | Sesselmann et al. | 112/105 |
| 3,974,785 | 8/1976 | Pickert et al. | 112/113 |
| 4,173,191 | 11/1979 | Taddicken | 112/113 X |
| 4,262,612 | 4/1981 | Schips | 112/114 |
| 4,362,116 | 12/1982 | Sen Gupta et al. | 112/113 X |
| 4,384,539 | 5/1983 | Scagnelli et al. | 112/105 |
| 4,497,270 | 9/1983 | Boser | 112/114 X |

FOREIGN PATENT DOCUMENTS 7118280 10/1975 Fed. Rep. of Germany .

*Primary Examiner*—Werner H. Schroeder
*Assistant Examiner*—Andrew M. Falik
*Attorney, Agent, or Firm*—Ostrolenk, Faber, Gerb & Soffen

[57] ABSTRACT

In a sewing machine, particularly one useful for producing piped pockets, wherein the pieces to be sewn to a workpiece include a slide fastener or zipper, a transfer device for transferring the slide fastener containing sewn pieces to the workpiece is provided. The transfer device includes a grip-fold stamp which is vertically movable toward the piece to be sewn which is held over a plate by vacuum, with the slide fastener held in a pocket of the plate. The grip-fold stamp is moved down to the plate and holds the area of the sewn piece adjacent to the slide fastener. A clamping strap on the grip-fold stamp is movable by an appropriate servoelement, either electromagnetic or air pressure cylinder, into the pocket in the plate and beneath the slide fastener for holding the sewn piece at the slide fastener at the underside of the grip-fold stamp. The clamping strap may be an arcuate piece that is shifted around the circular front of the grip-hold stamp to its clamping position or it may be a pivotally supported part which pivots to its clamping and releasing position. The clamping strap moves toward and with respect to a guide fixed to the underside for the grip-fold stamp.

15 Claims, 8 Drawing Figures

SEWN PART TRANSFER DEVICE FOR A SEWING MACHINE

BACKGROUND OF THE INVENTION

The present invention relates to a sewing machine having a transfer device used in holding a sewing piece, and particularly one provided with a slide fastener, to clamp the piece with respect to a workpiece.

A sewing machine having a transfer device for the piece to be sewn is shown in Federal Republic of Germany Utility Model No. 71 18 280. A piece of material, which is placed on a plate that is arranged above the sewing machine table, can be transferred to a workpiece. This transfer device, however, does not make it possible to transfer that piece of material to the workpiece if the piece of material is already provided with a cut-to-length slide fastener or zipper which has been sewn on the one side, particularly where the piece of material has been cut to a length and thus is already provided with the slide-fastener slide. The difficulty arises because the pull member of the slide-fastener slide must not change its predetermined position.

A transfer device is also known in which the take up and transfer of the strip of material is performed by oblique gripping needles which are provided on the grip-fold stamp and which can be temporarily extended. This transfer device also does not make it possible for a strip of material, which has the slide fastener cut to length and sewn on one side of the strip, to be transferred to the workpiece in such a manner that the predetermined position of the pull-member is retained.

SUMMARY OF THE INVENTION

The invention has as its object providing a transfer device which is able to transfer a strip, and particularly a folded strip, of material with a slide fastener sewn along one side, or merely the slide fastener itself, properly to an available workpiece, without the pull member of the slide-fastener slide changing its predetermined position.

This transfer device enables sewing of piped pockets which are closed by a slide fastener and are provided with piping on one or both sides. The pull member of the slide-fastener slide, which is now aligned for correct sewing, is held clamped by a grip-fold stamp hereinafter described during transfer to the workpiece, so that the predetermined position of the pull member does not change during the transfer.

According to the invention, a sewing machine, and particularly one that is useful for producing piped pockets, includes a transfer device for transferring sewn pieces that include a slide fastener or zipper to another workpiece. The transfer device includes a grip-fold stamp which is vertically movable toward the piece to be sewn. There is a plate on which the piece to be sewn is disposed and the plate has a groove or slot in it for receiving the slide fastener. The plate includes means, such as vacuum means, for holding the sewn piece to the plate with the slide fastener in the pocket provided for it. The grip-fold stamp moves down to the plate and holds the area of the sewn piece that is adjacent to the slide fastener. Then a clamping strap that is movable by an appropriate servoelement, either an electromagnetic armature or the piston of an air pressure cylinder, moves around the front of the grip-fold stamp around and into the groove in the plate beneath the slide fastener for holding the sewn piece at the slide fastener at the underside of the grip-fold stamp during the transfer to the workpiece. The clamping strap may be an arcuate piece that is moved around the curved front of the grip-fold stamp to the clamping position or it may be a pivotally supported part which pivots to the clamping and releasing positions.

Other objects and features of the invention will be explained with reference to the drawings.

DESCRIPTION OF A PREFERRED EMBODIMENT

Figure 6:
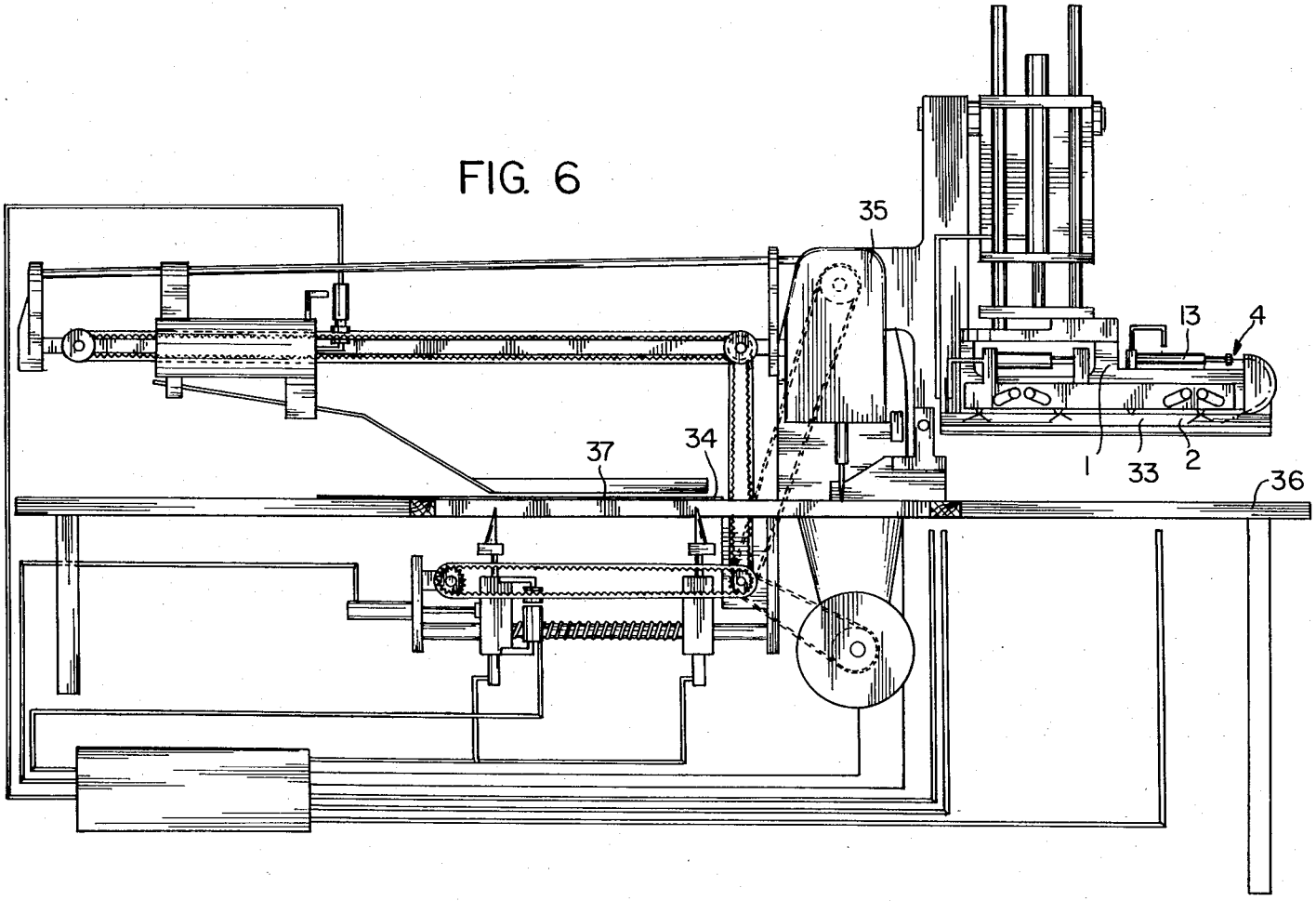
FIG. 6 is a schematic side view of an automatic braided-pocket sewing machine in which the present invention is mounted.

A transfer device, which is suitable for production of piped pockets, is fastened, inter alia, in known manner on the arm head of a sewing machine (not shown). The transfer device comprises a grip-fold stamp 1 which has oblique sewn piece gripping needles 33 which can be temporarily extended and these needles 33 are shown in principle in German Publication OS No. 2042 562 published Mar. 11, 1972. These needles or pins are used in addition to the below described clamping straps 5. The device also comprises a plate 2. The plate 2 is arranged above a sewing-material clamp which is in its insertion position, and which is, therefore, in front or upstream of the place of sewing. The sewing-material clamp affixes the workpiece which is then in the insertion position onto the sewing-machine plate and then displaces it into the sewing position (FIGS. 1 and 6).

The grip-fold stamp 1 is provided at its front end (at the right in FIGS. 1 and 2) with an arcuately guided clamping spring 27 which is made of resilient material, and preferably of spring strip steel.

Figures 1, 4:
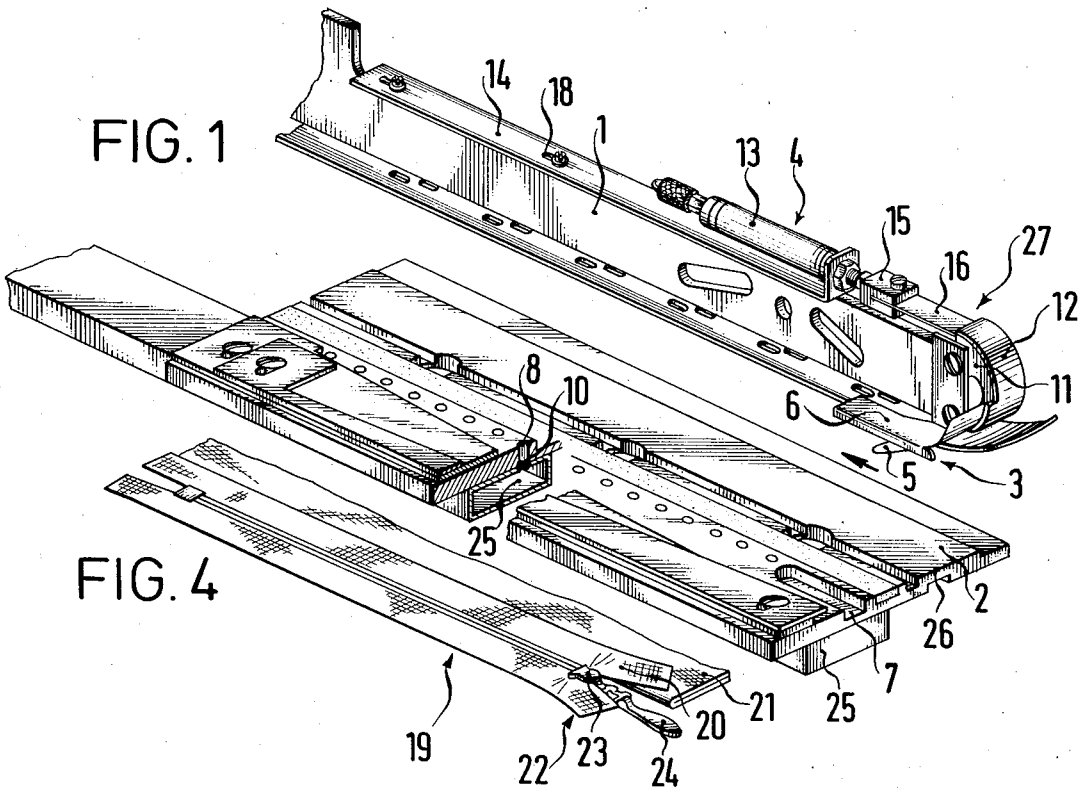
FIG. 1 is a perspective view of a transfer device of the invention, wherein the grip-fold stamp which is provided with the oblique gripping needles is shown in FIG. 2.
FIG. 4 is a view of the cut-to-length slide fastener with a folded strip of material sewn on one side.
Figure 2:
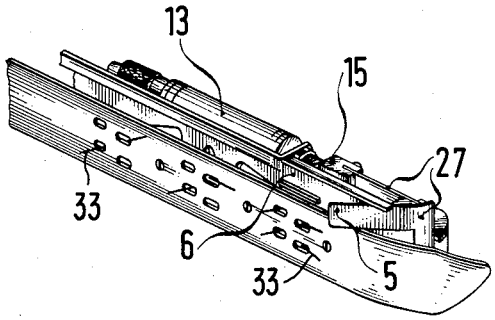
FIG. 2 is a perspective view of the bottom side of the grip-fold stamp.

The grip-fold stamp 1 and spring 27 will move in the direction indicated by the arrow in FIG. 1. The arrow in FIG. 1 therefore indicates the direction the clamping flat 5 travels in when cylinder 13 is charged with compressed air. In so doing, the forward edge of clamping flap 5 engages below the tensioner 24 of zipper slide 22 and forces it against the inside of guide 6. The tensioner 24 is clamped as follows:

First, specifically, sewing piece 19 is positioned on plate 2 in such a way that the pull member or tensioner on slide fastener 20 is accommodated by the insertion pocket 7 in plate 2. Insertion pocket 7 is basically designed so that the forward point of tensioner 24 never extends as far as the transverse side of plate 2, but is instead located at a distance in front of the transverse side. When gripper-fold punch 1 descends, the forward edge of the projecting clamping flap 5 (FIG. 1) encounters the floor of insertion pocket 7, specifically at the front, which the point of tensioner 24 does not reach. Clamping flap 5 accordingly assumes an almost horizontal orientation. When compressed-air cylinder 13 is then charged as already described, clamping flap 5 is shifted farther forward engaging below tensioner 24, which is accordingly clamped between clamping flap 5 and the inside of guide 6 as long as the cylinder remains charged.

Figure 3:
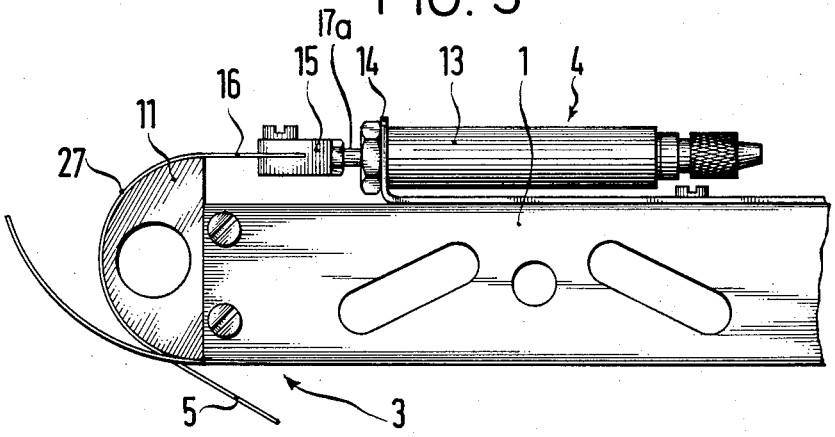
FIG. 3 is a side view of the grip-fold stamp, with the cover removed.
Figure 7:
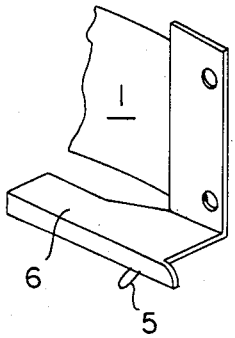
FIG. 7 is a view in perspective of the member 6 of FIG. 1 at the right side of the upper element of FIG. 1.

There is a spring support and deflection part 11 fastened on the front of the grip-fold stamp 1. Its front end is rounded and the rounded front is partially surrounded by the clamping spring 27, as shown in FIGS. 3 and 7. A semicircular shaped outside cover 12 fastened to the deflection part 11 and wrapped over the rounded front of the part 11 defines a space for the clamping spring 27 to permit its displacement only in the circumferential direction around the part 11. An upper strap 16 of the clamping spring 27 is received by the block 15 which is fastened to the piston rod of a compressed air cylinder 13, as shown in FIGS. 1 and 3. That cylinder 13 is a servoelement for the spring 27.

Figure 5:
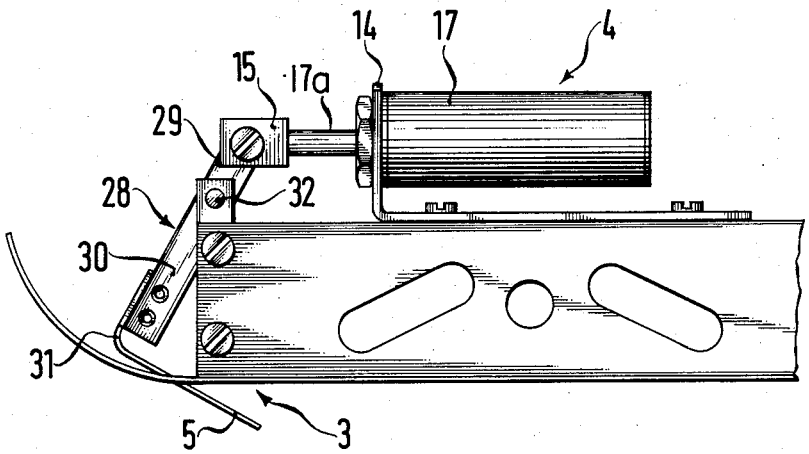
FIG. 5 is a view corresponding to FIG. 3 of an alternate embodiment of the grip-fold stamp.
Figure 8:
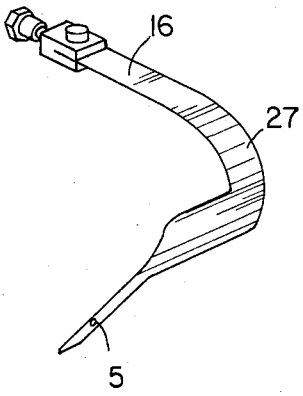
FIG. 8 is a view in perspective of the clamping spring 27 having the tip 5 which is visible at the upper right section of FIG. 1.

In another embodiment shown in FIG. 5, an electromagnet 17 is used as a servoelement 4 in place of air cylinder 13. Either the electromagnet or the compressed air cylinder 13 is mounted on a holding angle iron 14 which, in its turn, is fastened to the body of the gripfold stamp 1. Slots 18 through the holding angle iron 14 permit its displacement within a predetermined range in the longitudinal direction along the grip-fold stamp 1. This makes it possible to adjust the position of the front edge of a clamping strap 5 which is present on the clamping element 3 so that it might perform its proper function. As it is acted upon by the servoelement 4, the clamping strap 5 moves within the region of and generally beneath a guide 6, which is firmly connected to the gripfold stamp 1. Toward the end of the displacement of the clamping strap 5, it is surrounded on one side by the guide 6, Clamping strap 5 enters the U-shaped region when cylinder 13 is charged with air as described above which has a U-shaped development (see FIGS. 7 and 8).

In the embodiment shown in FIG. 5, the clamping element 3 comprises a double-armed clamping lever 28 which is swingably mounted on the grip-fold stamp 1 at a support point 32. The servoelement 4 acts on the arm 29 of the lever 28 via the block 15 to permit swinging of the clamping lever 28. An angle iron 31 of resilient material, preferably strip spring steel, is fastened to the other arm 30 of the lever 28. The free, resiliently yieldable arm of the angle iron 31 defines the clamping strap 5 of this embodiment.

The plate 2 has an insertion pocket 7 on its top side, as shown in FIG. 1. On the bottom of the plate 2, there is a rectangular tube 25 which defines a vacuum chamber. That chamber has a number of holes 10 which are aligned with the holes 8 through the plate, shown in FIG. 1. The holes 8 are aligned with the insertion pocket 7. In a simplified embodiment of the transfer device, the rectangular tube 25 can be dispensed with. This vacuum device holds the sewing piece to the plate.

The operation of the transfer device in accordance with the invention is now described. A prefinished sewing piece 19 includes a slide fastener 20 which is cut to length and is provided with a slide-fastener slide 22. A folded strip of material 21 is sewn on one side to the slide fastener, or else an individual slide fastener 20, without the material, is provided. The sewing piece is so placed on the plate 2 so that the bottom or back side of the slide-fastener slide 22 faces upward. The pull member 24 of the slide-fastener slide 22 is placed in the insertion pocket 7 and is positioned in a predetermined position.

The rectangular tube 25 attached to the plate 2 is connected to a suction-air unit (not shown), whereby a vacuum is produced in the rectangular tube 25 when the holes 8 and 10 are covered by a sewing piece 19 that has been placed on the plate 2. This vacuum permits proper alignment of the sewing piece 19 on the plate. Upon actuation of a switch, preferably pedal-actuated, the gripfold stamp 1 moves down upon that side of the slide fastener 20 that has been provided with the strip of material 21, and off to the side of the slide fastener. Lowering of the grip-fold stamp 1 brings the front edge of the clamping strap 5 against the bottom of the insertion pocket 7 which changes the position of the clamping strap 5. The strap 5 (see FIGS. 7 and 8) moves forward and passes under the pull member 24 which is now present in the insertion pocket 7. Shortly after the placement of the grip-fold stamp 1 onto the sewing piece 19, the oblique gripping needles on the bottom of the stamp 1, and visible in FIG. 2, protrude outward. At the same time, the servoelement 4 is acted on, i.e. the compressed air cylinder 13 is filled with compressed air. Its piston rod and the block 15 move out. The connection of the block 15 with the clamping element 3 moves the clamping strap 5 further forward and clamps the pull member 24 in the U-shaped region of the guide 6. This prevents a change in position of the pull member 24 as long as the servoelement 4 is acted upon.

In FIG. 6 there is shown the standard automatic braided-pocket sewing machine 35, the sewing machine table 36 carrying the sewing piece 19, sewing-material clamp 37, workpiece 34 and the gripping needles 33.

In the embodiment of FIG. 5, the clamping lever 28 is swung counter-clockwise (in FIG. 5) when the electromagnet 17 is actuated. The clamping strap 5 moves under the pull member 24 then in the insertion pocket 7 and clamps the pull member in the region of the guide 6 so long as the electromagnet 17 is connected.

By the extended oblique gripping needles, the sewing piece 19 or an individual slide fastener 20 is connected to the bottom of the grip-fold stamp 1. In this way, the sewing piece 19 or a slide fastener 20 individually placed on the plate 2 is removed by the grip-fold stamp 1 from the plate 2. A change in position of the pull member 24 which is held clamped is made impossible. The grip-fold stamp 1 moves down in known manner between the sewing-material clamps and thus transfers the sewing piece 19 in a workpiece held by the sewing-material clamp. After the grip-fold stamp 1 completes this operation, the gripping needles on its bottom side are retracted. At the same time the servoelement 4 is released, i.e. the compressed air cylinder 13 is depressurized or the electromagnet 17 is disconnected. The piston rod or armature rod 17*a* moves back into its initial position under the bias of a return spring. The clamping strap 5 is thereby also moved back into its initial position. In this way, the pull member 24 is released without being able to change its predetermined position. It retains its predetermined position upon the following sewing process which is necessary for the production of the piped pocket, so that the pull member does not interfere with the sewing process.

Prior to this, the grip-fold stamp 1 is again returned into its starting position above the plate 2 and it is ready to receive the next following sewing piece 19 whose pull member 24 is positioned and clamped in position ready for sewing.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A sewing machine, comprising:

a sewing machine table;

a plate above the table for holding a piece of sewing material that is to be transferred to a workpiece on the table;

a transfer device for transferring a strip of material on the plate to the workpiece; the transfer device comprising a grip-fold stamp; means for moving the clamping element to clamp to the piece of material on the plate;

the clamping element including a clamping strap which is movable from a location away from the underside of the grip-fold stamp toward the underside of the grip-fold stamp; a guide at the underside of the grip-fold stamp toward which the clamping strap is movable and for cooperating with the clamping strap for gripping material; and the plate including an insertion pocket defined on its upper side facing toward the grip-fold stamp, and the insertion pocket being beneath the clamping element for the clamping element to move into the pocket beneath the said piece of material on the plate for clamping to the said piece of material there so that said clamping element can move into the insertion pocket beneath said material piece to clamp said material piece.

2. The sewing machine of claim 1, wherein the grip-fold stamp is supported in the sewing machine for swinging between the positions toward and away from the plate.

3. The sewing machine of claim 1, wherein the guide has a pair of legs making it generally U-shaped, and the clamping strap moves toward the guide between the legs of the guide.

4. The sewing machine of claim 1, further comprising a sewing material clamp for clamping a workpiece on the table top.

5. The sewing machine of claim 1, further comprising a servoelement on the grip-fold stamp and connected with the clamping strap for moving the strap.

6. The sewing machine of claim 5, wherein the servoelement comprises a compressed air cylinder device, including a cylinder connected with the grip-fold stamp; a piston in the compressed air cylinder and being displaceable in the longitudinal direction of the grip-fold stamp, and being connected with the clamping strap for moving the clamping strap as the compressed air cylinder is operated to move the piston thereof.

7. The sewing machine of claim 5, wherein the servoelement comprises an electromagnet which is connected to the grip-fold stamp, on the one hand, and which includes an armature that is displaceable in the longitudinal direction of the grip-fold stamp; the clamping strap being connected with the armature of the electromagnet for moving between the clamping and unclamping positions.

8. The sewing machine of claim 1, wherein the grip-fold stamp has a front end, and the clamping element is disposed at the front end of the grip-fold stamp.

9. The sewing machine of claim 8, wherein the clamping strap comprises a curved clamping strap, which is guided to be moved arcuately, generally around a semicircle; the clamping strap being shaped such that motion of the strap in one direction clamps the sewing material to the grip-fold stamp.

10. The sewing machine of claim 9, further comprising a servoelement on the grip-fold stamp and connected with the clamping strap for moving it.

11. The sewing machine of claim 9, wherein the front of the grip-fold stamp is arcuately curved and the clamping strap moves around the arcuately curved front end.

12. The sewing machine of claim 11, further comprising an arcuately curved cover over the front of the grip-fold stamp for guiding the clamping strap beneath the cover arcuately around the front of the grip-fold stamp.

13. The sewing machine of claim 9, further comprising an arcuately curved cover over the front of the grip-fold stamp said cover guiding the clamping strap beneath the cover arcuately around the front of the grip-fold stamp.

14. The sewing machine of claim 8, further comprising a servoelement on the grip-fold stamp and connected with the clamping strap for moving it;

a double-armed clamping lever which is swingably mounted to the grip-fold stamp; one of the arms of the clamping lever being connected with the servoelement; the other arm of the clamping lever forming the clamping strap; said clamping strap being resilient and being moved to clamp the sewing piece upon movement of the servoelement.

15. The sewing machine of claim 1, wherein the plate has holes passing through it generally in a row that is generally aligned with the pocket in the plate; a tube beneath the plate at the holes and including means communicating with the holes in the plate such that upon a vacuum being drawn in the tube, the sewing piece is held by vacuum suction to the plate.

* * * * *